US009848651B2

(12) United States Patent
Wu

(10) Patent No.: US 9,848,651 B2
(45) Date of Patent: Dec. 26, 2017

(54) ELECTRONIC ATOMIZATION DEVICE

(71) Applicant: SHENZHEN JIESHIBO TECHNOLOGY CO., LTD., Shenzhen, Guangdong (CN)

(72) Inventor: Jianyong Wu, Guangdong (CN)

(73) Assignee: SHENZHEN JIESHIBO TECHNOLOGY CO., LTD., Shenzhen (CN)

( * ) Notice: Subject to any disclaimer, the term of this patent is extended or adjusted under 35 U.S.C. 154(b) by 172 days.

(21) Appl. No.: 14/919,876

(22) Filed: Oct. 22, 2015

(65) Prior Publication Data

US 2016/0113327 A1 Apr. 28, 2016

(30) Foreign Application Priority Data

Oct. 24, 2014 (CN) ..... 2014 2 0624028 U

(51) Int. Cl.
*A24F 47/00* (2006.01)
*H05B 3/06* (2006.01)

(52) U.S. Cl.
CPC ..... *A24F 47/008* (2013.01); *H05B 3/06* (2013.01)

(58) Field of Classification Search
CPC ..... A24F 47/008
See application file for complete search history.

(56) References Cited

U.S. PATENT DOCUMENTS

2013/0068239 A1* 3/2013 Youn ..... A24F 47/008 131/273
2013/0167853 A1* 7/2013 Liu ..... A24F 47/008 131/329
2013/0180533 A1* 7/2013 Kim ..... A24F 47/008 131/273
2013/0192618 A1* 8/2013 Li ..... A24F 47/008 131/329
2014/0150783 A1* 6/2014 Liu ..... A24F 47/008 128/202.21
2016/0270442 A1* 9/2016 Liu ..... A24F 47/008

* cited by examiner

*Primary Examiner* — Eric Yaary

(57) ABSTRACT

Disclosed is an electronic atomization device, which includes a suction nozzle, an oil cup assembly, an atomization core assembly and an electrode assembly. The atomization core assembly includes a heater support with a first stepped structure, an atomization core body supported by the heater support, a sealing washer sleeved on the atomization core body and closely contacting with the first stepped structure, an electrode connecting part connected with an end of the heater support via an insulating ring and an air hole connecting part disposed in the atomization core body. The oil cup assembly includes an oil cup body having an airway tube for connecting with the air hole connecting part, a first connecting element removably connected with the suction nozzle and a second connecting element having a second stepped structure formed therein for fitting the sealing washer. According to the present invention, its atomization core is easy to be changed.

7 Claims, 4 Drawing Sheets

ELECTRONIC ATOMIZATION DEVICE

CROSS-REFERENCE TO RELATED APPLICATIONS

This present invention claims the benefit of Chinese Patent Application No. CN201420624028.8, filed on Oct. 24, 2014; the contents of which are hereby incorporated by reference.

FIELD OF THE INVENTION

The present invention relates to electronic atomization device, in particular, it concerns an electronic atomization device which has an atomization core easy to be changed.

BACKGROUND OF THE INVENTION

Electronic atomization device, also called electronic cigarette or atomization tobacco with low temperature, is mainly used for reducing harm brought by smoking traditional cigarette. Its appearance and taste are similar to cigarette and it has more flavors than even normal cigarette does. It can also create a cloud, a taste and a feel that resemble cigarette. The electronic atomization device, which is composed of battery assembly and atomizer, is an imitative cigarette, and flavor components therein can be atomized into gas by atomization device so that user can inhale it directly. The flavor materials include tobacco liquid, tobacco shred, tobacco powder, tobacco paste, fragrant slice, fragrant bar, liquid tobacco and so on.

The flavor materials are generally added into an oil cup of the atomization device and then are atomized into gas by an atomization core of the atomization device. Generally, the atomization core is needed to be replaced with a new one when it is broken or to be replaced with another one when the user wants to change the flavor materials with different tastes. However, for the existing atomization device, its atomization core and its airway tube are generally assembled together by threaded connection or by latch structure, thus it is very inconvenient to disassemble and it will make the hands of user dirty with tobacco tar during the disassembling.

SUMMARY OF THE INVENTION

An object of the present invention is to provide an electronic atomization device provided with an atomization core easy to be changed so as to overcome the defects of the prior art. It is easy to change the atomization core; it can avoid making the hands of user dirty with tobacco tar and it has good performance of safety and health.

To achieve above objects, there is provided an electronic atomization device, which includes a suction nozzle, an oil cup assembly, an atomization core assembly disposed in the oil cup assembly and an electrode assembly electrically connected with the atomization core assembly. The atomization core assembly includes a heater support with a first stepped structure, an atomization core body supported by the heater support, a sealing washer sleeved on the atomization core body and closely contacting with the first stepped structure, an electrode connecting part connected with an end of the heater support via an insulating ring and an air hole connecting part disposed in the atomization core body; the oil cup assembly includes an oil cup body, a first connecting element removably connected with the suction nozzle and a second connecting element removably connected with the electrode assembly, the oil cup body having an airway tube disposed therein for connecting with the air hole connecting part and the second connecting element having a second stepped structure formed therein for fitting the sealing washer; and the atomization core assembly is disposed between the second connecting element and the electrode assembly, the electrode connecting part is connected with a positive electrode of the electrode assembly and the heater support is connected with a negative electrode of the electrode assembly.

In a preferable embodiment, the electrode assembly is assembled with the second connecting element via threaded connection.

In a preferable embodiment, the second connecting element has a stopper formed therein for stopping the first stepped structure.

In a preferable embodiment, the atomization core body has an ID chip disposed therein.

In a preferable embodiment, there is at least one protrusion made of elastic materials provided on an outside surface of the first connecting element.

In a preferable embodiment, the protrusion is made of rubber or silicon.

In a preferable embodiment, the protrusion includes a long strip body and a plurality of convex bumps formed on a surface of the long strip body.

The above technical solutions have following beneficial effects: the atomization core assembly is loaded into the oil cup assembly and then is pressed and fixed in the oil cup assembly via a thread connection between the electrode assembly and the second connecting element of the oil cup assembly; during screwing the electrode assembly onto the second connecting element, the stepped structures contact with the sealing washer closely so that the atomization core assembly has good sealing performance, at the same time, the stopper will contacts with the heater support so that the electrode assembly and the atomization core assembly have good contact with each other, thereby ensuring the circuit thereof is connected. The ID chip disposed in the atomization core assembly is used for recording puff number of the electronic atomization device. When the recorded puff number reaches to a preset value, the electronic atomization device will stop working.

Other aspects, features, and advantages of this invention will become apparent from the following detailed description when taken in conjunction with the accompanying drawings, which are a part of this disclosure and which illustrate, by way of example, principles of the present invention.

DETAILED DESCRIPTION OF ILLUSTRATED EMBODIMENTS

Figure 1:
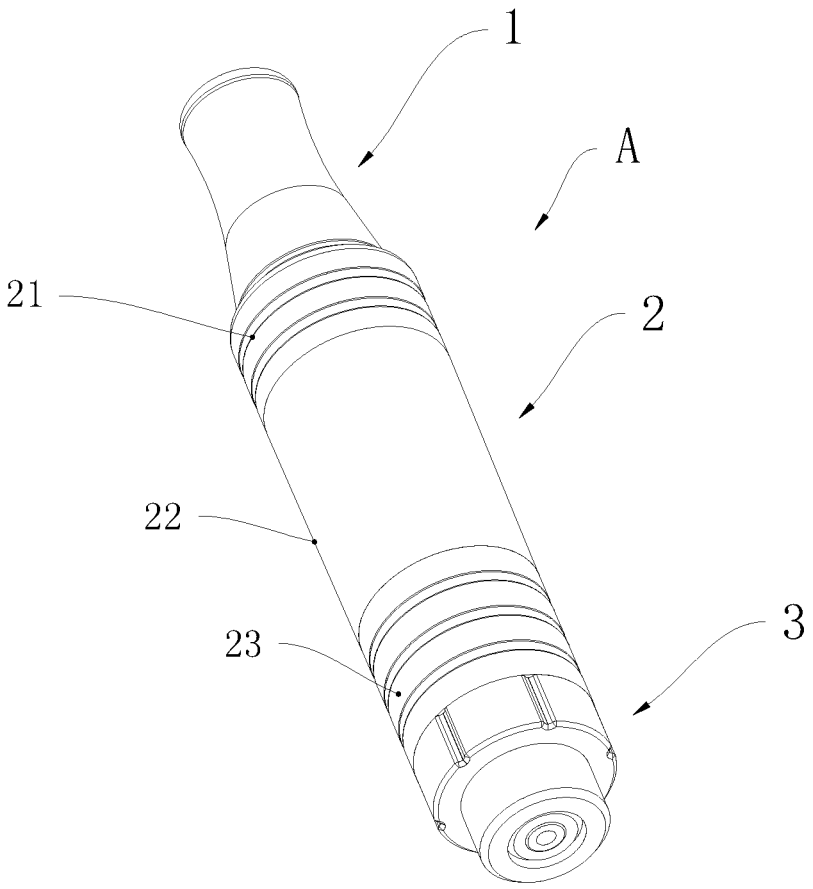
FIG. 1 is a perspective view of an electronic atomization device according to a first embodiment of the present invention.
Figure 2:
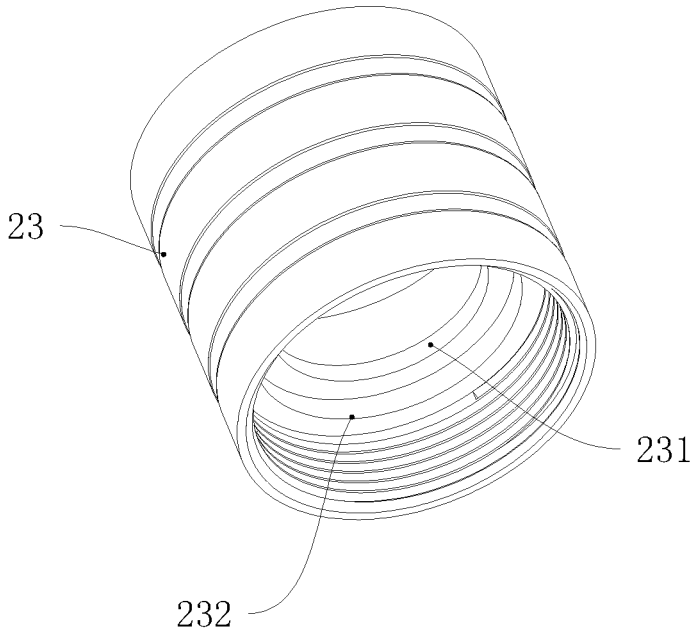
FIG. 2 is a perspective view of a second connection part of the electronic atomization device according to the first embodiment of the present invention.
Figure 3:
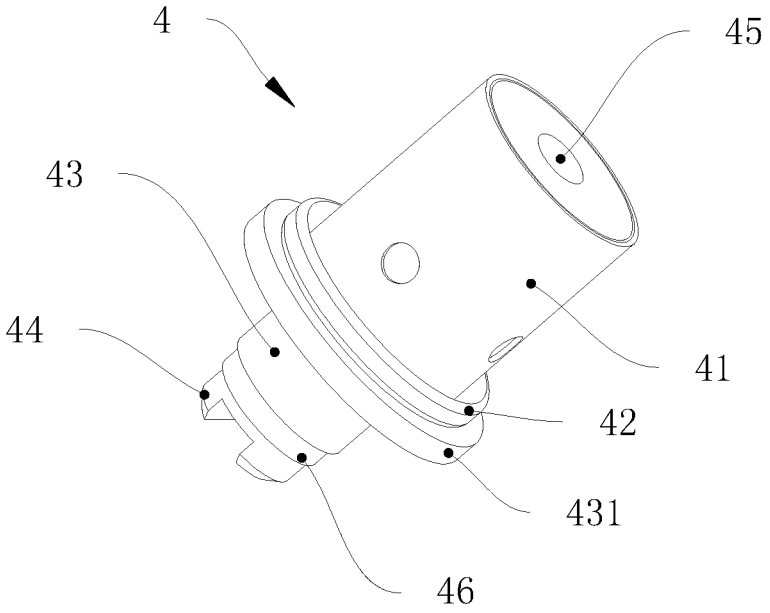
FIG. 3 is a perspective view of an atomization core assembly of the electronic atomization device according to the first embodiment of the present invention.
Figure 4:
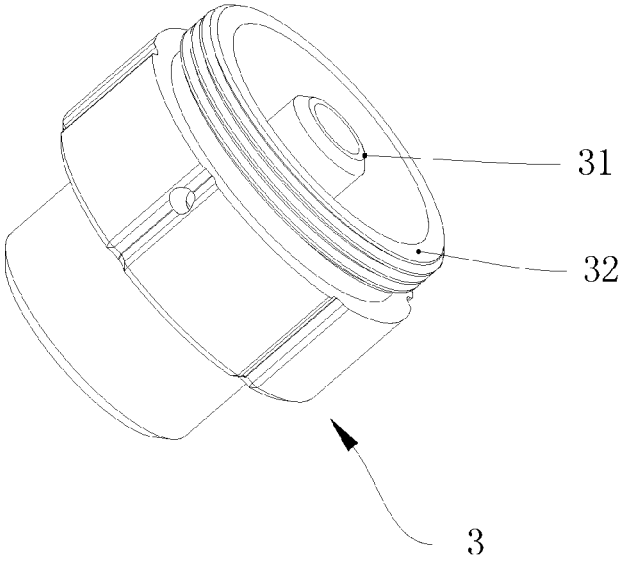
FIG. 4 is a perspective view of an electrode assembly of the electronic atomization device according to the first embodiment of the present invention.

Some embodiments of the present invention will be described as follows, by way of example only, with reference to the accompanying drawings.

FIG. 1 to FIG. 4 shows a first embodiment of the present invention. As shown from FIG. 1 to FIG. 4, the electronic atomization device includes a suction nozzle 1, an oil cup assembly 2, an atomization core assembly 4 disposed in the oil cup assembly 2 and an electrode assembly 3 electrically connected with the atomization core assembly 4. The atomization core assembly 4 includes a heater support 43 provided with a first stepped structure 431, an atomization core body 41 supported by the heater support 43, a sealing washer 42 sleeved on the atomization core body 41 and closely contacting with the first stepped structure 431 for avoiding oil leakage, an electrode connecting part 44 connected with an end of the heater support 43 via an insulating ring 46, and an air hole connecting part 45 disposed in the atomization core body 41. The oil cup assembly 2 includes an oil cup body 22, a first connecting element 21 removably connected with the suction nozzle 1 and a second connecting element 23 removably connected with the electrode assembly 3. The oil cup body 22 has an airway tube disposed therein for connecting with the air hole connecting part 45 and the second connecting element 23 has a second stepped structure 231 formed therein for fitting the sealing washer 42. The atomization core assembly 4 is disposed into the second connecting element 23 and closely connected with the electrode assembly 3, the electrode connecting part 44 is connected with a positive electrode 31 of the electrode assembly 3 and the heater support 43 is connected with a negative electrode 32 of the electrode assembly 3.

The first connecting element 21 is assembled onto an end of the oil cup body 22 and the second connecting element 23 is assembled onto another end of the oil cup body 22 so as to constitute the oil cup assembly 2 together. The suction nozzle 1 is assembled onto the first connecting element 21 via threaded connection. The second connecting element 23 is connected with the electrode assembly 3 removably. When the atomization core assembly 4 is assembled into the second connecting element 23, the sealing washer 42 contacts with the first stepped structure 431 and the second stepped structure 231 closely. When the electrode assembly 3 is assembled onto the second connecting element 23, the atomization core assembly 4 is pushed against the second connecting element 23 by the electrode assembly 3 so that the sealing washer 42 contacts with the second stepped structure 231 closely and then the air hole connecting part 45 is hermetically connected with the airway tube disposed in the oil cup body 22. And the electrode connecting part 44 closely contacts with the positive electrode 31 of the electrode assembly 3 and the heater support 43 closely contact with the negative electrode 32 of the electrode assembly 3 so that good electrical connections are built between the electrode connecting part 44 and the positive electrode 31 of the electrode assembly 3 and between the heater support 43 and the negative electrode 32 of the electrode assembly 3.

When the atomization core assembly 4 is needed to be replaced with another one, it just needs to disassemble the electrode assembly 3 from the second connecting element 23 then the atomization core assembly 4 could be removed easily.

In this embodiment, the electrode assembly 3 is connected with the second connecting element 23 via threaded connection so that the electrode assembly 3 could be removed from the second connecting element 23 easily. The second connecting element 23 has a stopper 232 formed therein for stopping the first stepped structure 431 so as to avoid excessive pressure on the atomization core assembly 4 and ensure there is good electrical connection between the atomization core assembly 4 and the electrode assembly 3. In this embodiment, the distance between the stopper 232 and the second stepped structure 231 is smaller than the thickness of the sealing washer 42 so that the sealing washer 42 could contacts with the first stepped structure 431 and the second stepped structure 231 closely and then the electrode connecting part 44 and the electrode assembly 3 have a good electrical connection, and additionally it can prevent the atomization core assembly 4 from being pressed against the second stepped structure 231 overly. In this embodiment, the ID chip disposed in the atomization core assembly 4 is a RFID chip, which is used for recording the puff number of the electronic atomization device. When the recorded puff number reaches to a preset value, the electronic atomization device will stop working.

Figure 5:
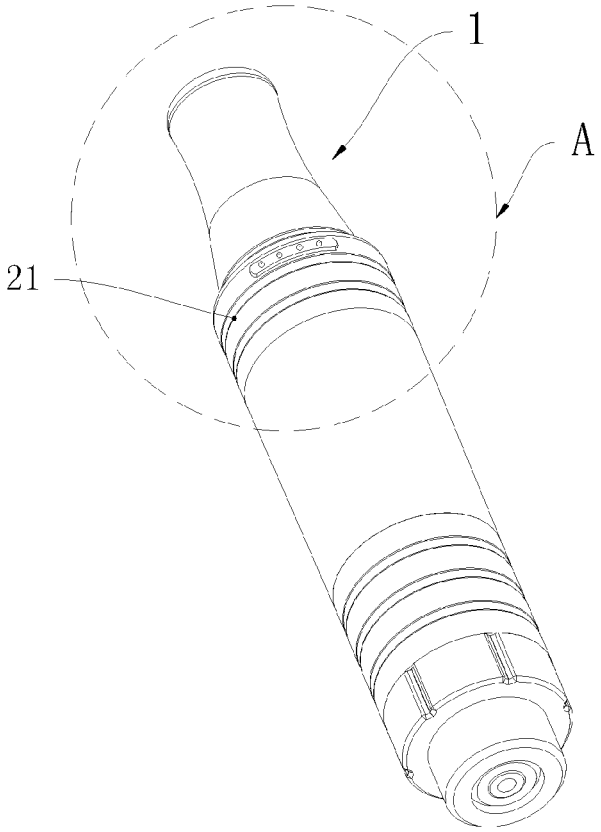
FIG. 5 is a perspective view of an electrode assembly of the electronic atomization device according to a second embodiment of the present invention.
Figure 6:
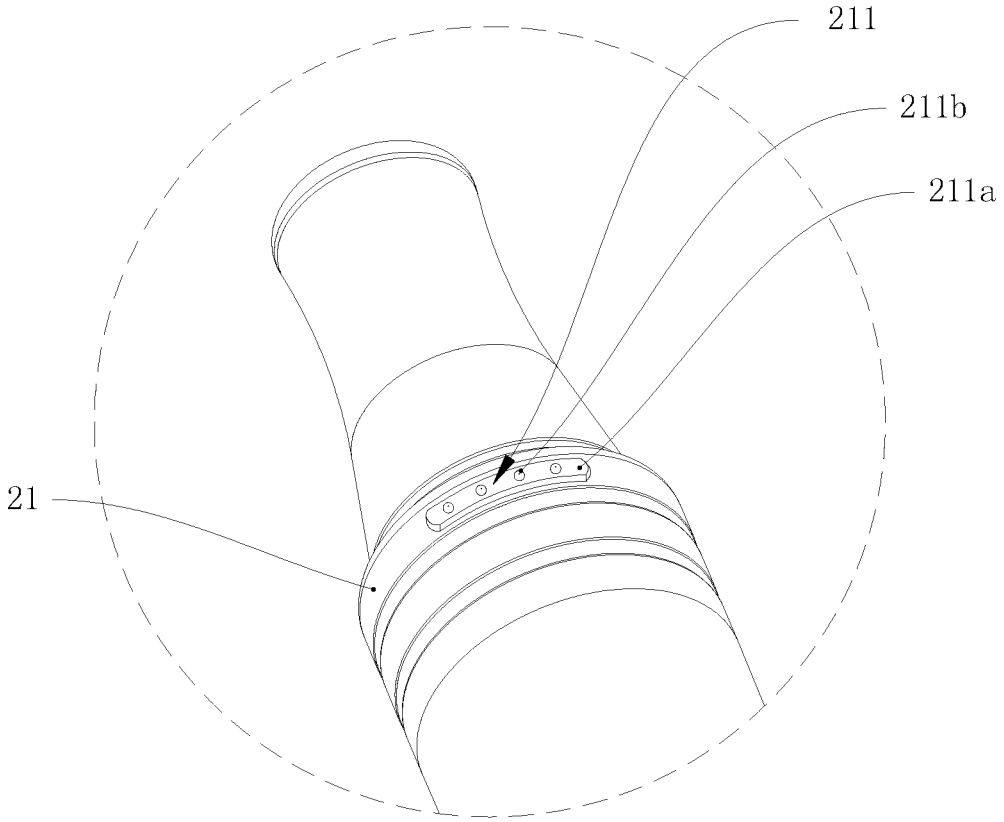
FIG. 6 is an enlarged view of part A shown in FIG. 5.

FIG. 5 to FIG. 6 shows a second embodiment of the present invention. In this embodiment, there is at least one protrusion 211 made of elastic material provided on an outside surface of the first connecting element 21 so as to improving hand feeling. In this preferred embodiment, the protrusion 211 includes a long strip body 211*a* and a plurality of convex bumps 211*b* formed on a surface of the long strip body 211*a*. The protrusion 211 could be made of rubber or silicon.

Now the assembling process of the electronic atomization device of the present invention will be described as follows:

Firstly, insert the atomization core assembly 4 into the second connecting element 23; screw the electrode assembly 3 onto the second connecting element 23 tightly, during screwing, the sealing washer 42 being pressed onto the second stepped structure 231 tightly so that the air hole connecting part 45 is hermetically connected with the airway tube disposed in the oil cup body 22; continue to screw the electrode assembly 3 onto the second connecting element 23, at this time, the first stepped structure 431 of the heater support 43 contacts with the stopper 232 so as to prevent the atomization core assembly 4 from being pressed against the second stepped structure 231 overly and ensure the electrode connecting part 44 and the electrode assembly 3 have a good electrical connection.

Above descriptions of embodiments are provided for further illustrating the technical content of the present invention, so as to facilitate understanding. It should be understood that the invention is not to be limited to the disclosed embodiments. Any technique extension and recreation according to the present invention should be included within the scope of protection of the invention.

What is claimed is:

1. An electronic atomization device, comprising a suction nozzle, an oil cup assembly, an atomization core assembly disposed in the oil cup assembly and an electrode assembly electrically connected with the atomization core assembly, wherein the atomization core assembly comprises a heater support with a first stepped structure, an atomization core body supported by the heater support, a sealing washer sleeved on the atomization core body and closely contacting with the first stepped structure, an electrode connecting part connected with an end of the heater support via an insulating ring and an air hole connecting part disposed in the atomization core body; the oil cup assembly comprises an oil cup body, a first connecting element removably connected with the suction nozzle and a second connecting element removably connected with the electrode assembly, the oil cup body having an airway tube disposed therein for connecting with the air hole connecting part and the second connecting element having a second stepped structure formed therein for fitting the sealing washer; and the atomization core assembly is disposed between the second connecting element and the electrode assembly, the electrode connecting part is connected with a positive electrode of the electrode assembly and the heater support is connected with a negative electrode of the electrode assembly.

2. The electronic atomization device according to claim 1, wherein the electrode assembly is assembled with the second connecting element via threaded connection.

3. The electronic atomization device according to claim 1, wherein the second connecting element has a stopper formed therein for stopping the first stepped structure.

4. The electronic atomization device according to claim 1, wherein the atomization core body has an ID chip disposed therein.

5. The electronic atomization device according to claim 1, wherein there is at least one protrusion made of elastic materials provided on an outside surface of the first connecting element.

6. The electronic atomization device according to claim 5, wherein the protrusion is made of rubber or silicon.

7. The electronic atomization device according to claim 5, wherein the protrusion comprises a long strip body and a plurality of convex bumps formed on a surface of the long strip body.

* * * * *